US007315288B2

(12) United States Patent
Livingston et al.

(10) Patent No.: US 7,315,288 B2
(45) Date of Patent: Jan. 1, 2008

(54) ANTENNA ARRAYS USING LONG SLOT APERTURES AND BALANCED FEEDS

(75) Inventors: Stan W. Livingston, Fullerton, CA (US); Jar J. Lee, Irvine, CA (US); Richard J. Koenig, Buena Park, CA (US)

(73) Assignee: Raytheon Company, Waltham, MA (US)

( * ) Notice: Subject to any disclaimer, the term of this patent is extended or adjusted under 35 U.S.C. 154(b) by 345 days.

(21) Appl. No.: 10/760,037

(22) Filed: Jan. 15, 2004

(65) Prior Publication Data

US 2005/0156802 A1 Jul. 21, 2005

(51) Int. Cl.
*H01Q 13/10* (2006.01)

(52) U.S. Cl. ..... 343/770; 343/767

(58) Field of Classification Search ..... 343/700 MS, 343/702, 846, 872, 767, 770, 778, 797
See application file for complete search history.

(56) References Cited

U.S. PATENT DOCUMENTS 4,409,595 A 10/1983 Park
4,719,470 A * 1/1988 Munson ..... 343/700 MS
4,870,426 A * 9/1989 Lamberty et al. ..... 343/727
5,086,304 A * 2/1992 Collins ..... 343/778
5,266,961 A 11/1993 Milroy
5,428,364 A 6/1995 Lee et al.
5,504,493 A * 4/1996 Hirshfield ..... 342/372
5,565,875 A 10/1996 Buralli et al.
5,825,334 A 10/1998 Gherardini et al.
6,002,367 A * 12/1999 Engblom et al. .... 343/700 MS
6,166,701 A * 12/2000 Park et al. ..... 343/771
6,225,959 B1 5/2001 Gordon
6,567,048 B2 * 5/2003 McKinzie et al. ... 343/700 MS
6,624,787 B2 * 9/2003 Puzella et al. ..... 343/700 MS
6,653,984 B2 * 11/2003 Park et al. ..... 343/770
7,126,553 B1 * 10/2006 Fink et al. ..... 343/767

OTHER PUBLICATIONS

Wide Band Long Slot Array Antennas, J.J. Lee, S. Livingston, R. Koenig, IEEE Antennas and Wireless Propagation Letters, Jun. 2003, pp. 452-455.

Lee, J.J., et al, "Wideband Long Slot Array Antennas," IEEE Antennas and Propagation Society Inernational Symposium, 2003 Digest. APS., Columbus, OH, Jun. 22-27, 2003, New York, NY: IEEE, US, vol. 4 of 4, pp. 452-455, XP010649837, ISBN: 0-7803-7846.

EP 1 267 448 A (Raytheon Company), Dec. 18, 2002. Abstract; figures 1-5.

* cited by examiner

*Primary Examiner*—Douglas W. Owens
*Assistant Examiner*—Jimmy Vu
(74) *Attorney, Agent, or Firm*—Leonard A. Alkov

(57) ABSTRACT

An antenna array includes an array of continuous slots formed in a ground plane structure. A feed structure for exciting the slots includes a periodic set of probe feeds disposed behind the ground plane structure.

8 Claims, 5 Drawing Sheets

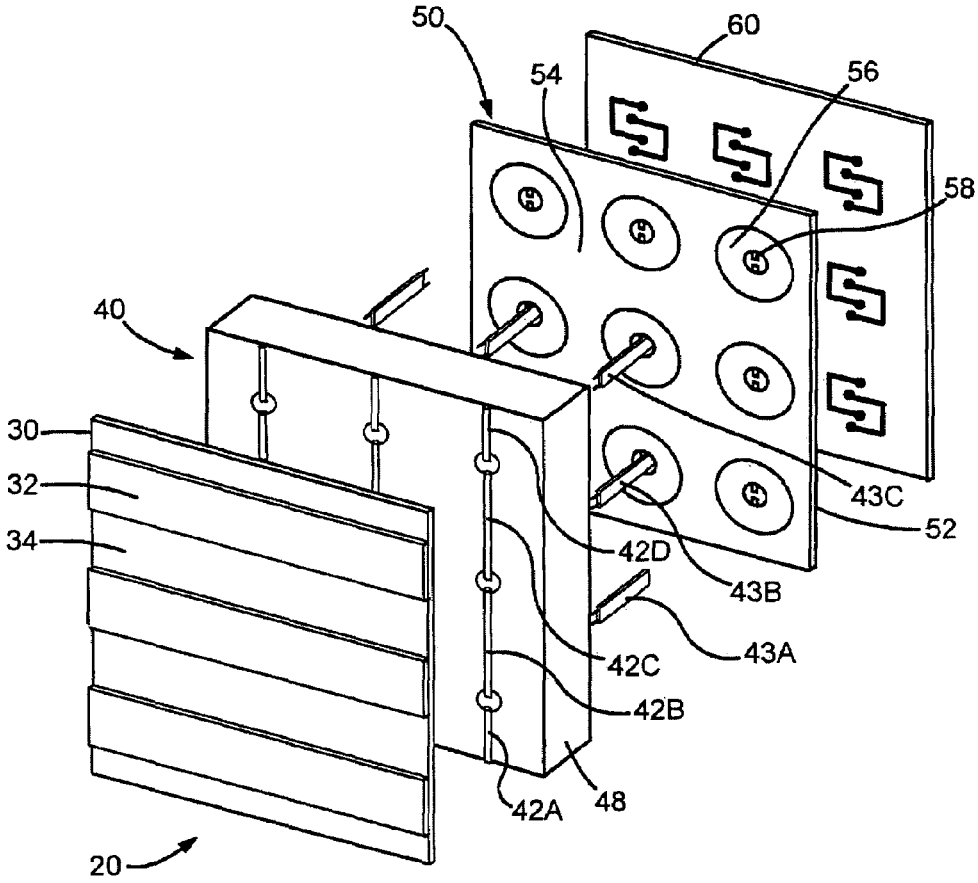
FIG. 1
FIG. 1A
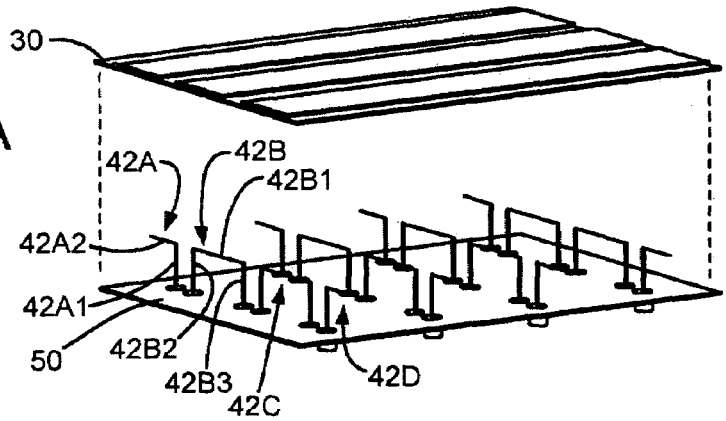

ANTENNA ARRAYS USING LONG SLOT APERTURES AND BALANCED FEEDS

BACKGROUND

Conventional phased arrays use discrete radiating elements that are costly to machine or fabricate. The bandwidth of a conventional phased array depends on the depth of the radiator above the ground plane. The radiating elements are one or two wavelength long if wide band and good efficiency or both desired. For low bands such as UHF, existing designs suffer in bandwidth performance when platforms of limited depth are used. Typically for wide band, a long impedance taper (flared notch) is required to match between transmission line feeds of 50 ohms to free space's 377 ohms in a square lattice.

There is a need for an array which can be more readily produced. There is also a need for an array which provides a depth reduction.

SUMMARY OF THE DISCLOSURE

An antenna array includes an array of continuous slots formed in a ground plane structure. A feed structure for exciting the slots includes a periodic set of probe feeds disposed behind the ground plane structure.

BRIEF DESCRIPTION OF THE DRAWINGS

Features and advantages of the disclosure will readily be appreciated by persons skilled in the art from the following detailed description when read in conjunction with the drawing wherein:

FIG. 1 is an isometric exploded view of an exemplary embodiment of an antenna structure.

FIG. 1A illustrates an isometric exploded view of another exemplary embodiment of an antenna structure.

DETAILED DESCRIPTION

Figure 2A:
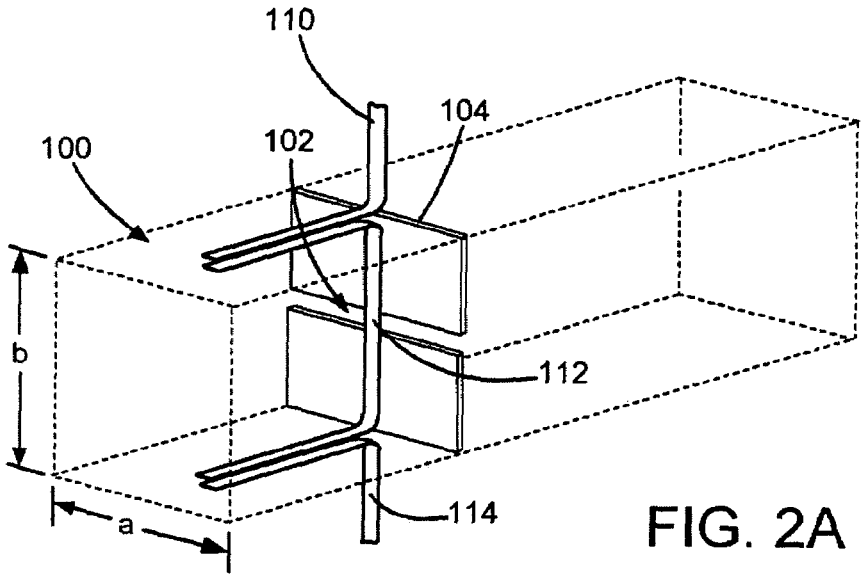
FIG. 2A illustrates a model of a unit cell for an antenna array.

In the following detailed description and in the several figures of the drawing, like elements are identified with like reference numerals.

An exemplary embodiment of a wide band low profile array antenna 20 is illustrated in the exploded isometric view of FIG. 1. The antenna comprises a dielectric substrate 30 with a top dielectric surface covered by a conductor layer such as copper. Continuous slots 34 are formed in the conductor layer.

The slots are excited by a probe feed structure comprising a plurality of probe feeds 40 located behind the substrate 30. In this embodiment, the probe feeds comprise a series of feed lines, includes lines 42A, 42B, 42C, disposed transversely to the longitudinal axes of the slots, and connected to a balanced push-pull feed source. In the embodiment of FIG. 1, the feed lines are supported by a dielectric support structure, such as a dielectric substrate, e.g. a dielectric foam layer 48, or fiberglass ribs or honeycomb, although the lines can alternatively be supported in air, as illustrated in FIG. 1A. The feed lines include opposed line pairs which are connected to a push-pull feed source. For example, lines 42A and 42B are respectively connected to wires of a balanced 300 ohm twin lead feed 42A, lines 42B and 42C are connected to wires of balanced twin lead feed 43B, and lines 42C and 42D are connected to wires of balanced twin lead feed 43D. The feeds are spaced at a Nyquist interval such that each can be independently phased as to provide beam steering in 2 dimensions without creating grating lobes. The Nyquist sampling theorem for digital conversion of time varying signals can also be applied to space varying signals. In this case, applicants theorize that by sampling at least every half wavelength spatially at the highest operating frequency, the bandwidth spectrum of the frequencies being received or transmitted is preserved.

A metallic back plane 50 behind the slots shields the RF waves from the remaining electronics such as receiver exciter, phase shifters, balun transmission lines, etc. In this exemplary embodiment, the back plane comprises a dielectric substrate 52, e.g. Rogers 4003 dielectric, with a top surface having a layer 54 of conductive material, e.g. copper formed thereon the back plane. The conductive layer 54 has cutouts or open areas 56 formed therein to allow the twin lead feeds to connect to conductive vias 58 without shorting to the back plane.

In this exemplary embodiment, a stripline transformer structure 60 is provided to transforming a 50 ohm impedance from an exciter or receiver structure into 150 ohm impedance for the balanced feed.

FIG. 1A shows in a simplified exploded isometric view the alternate case in which the feed lines of the probes are supported in air, including exemplary feed lines 42A, 42B, 42C and 42D. Note that, as in the embodiment of FIG. 1, each feed line includes a vertical portion and a horizontal or parallel portion which extends in a generally parallel relationship with the slot layer 30, including, by way of example, for feed line 42A, vertical or transverse feed line portion 42A1 and parallel portion 42A2.

It is also noted that the parallel feed line portions traversing the lateral extent of a slot, e.g. 42B, include a parallel feed line portion, e.g. 42B, include a parallel feed line portion, e.g. 42B1, having each end connected to a vertical line portion, e.g. 42B2, 42B3. The vertical line portions are connected to feed excitation signals which are in anti-phase, as described more fully below.

An exemplary embodiment of the array efficiently transfers the RF power from a periodic lattice structure formed by the array into free space over a wide band and scan volume. Consider the model of a unit cell 100 shown in FIG. 2A, of height b and width a. A continuous slot 102 is formed in a conductor plane 104. The slot is excited by a push-pull balanced feed circuit comprising feed lines 110, 112, 114 which are not in direct contact with the conductor plane 104. The driving impedance of the feed across the slot 102 is made to match the wave impedance of the free space over the unit cell, 377*b/a ohms, where a and b are the width and height of each unit cell in the array environment for broadside beam. The impedance changes slightly for E- and H-plane scans by cos(theta) or 1/cos(theta) factor, respectively where theta is the scan angle of the beam from broadside. As long as the width of the unit cell, a, is less than one half wavelength of the highest operating frequency, the higher order modes radiating from the slot will be minimized.

Figure 2B:
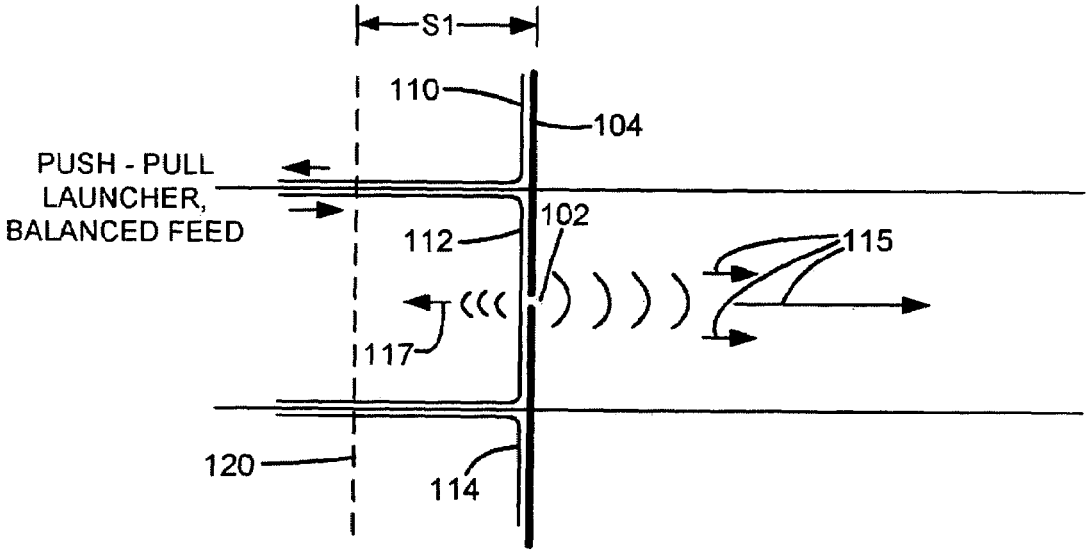
FIG. 2B illustrates a model of a unit cell for an antenna array comprising a back plane spaced behind the slot of the unit cell.

FIG. 2B illustrates the case in which a back plane 120 is located a distance S1 behind the slot plane. For the case in which S1=¼ wavelength, the back plane is an open circuit, and has no electrical effect. In practice, a distance S1 of between somewhat less than ⅛ and somewhat greater than ½ wavelength at an operating frequency provides acceptable performance.

For the cases illustrated in FIGS. 1-2B, the fundamental propagation mode can be described by a simple transmission line model, where the characteristic impedance for the wave going forward (represented by arrows 115, FIG. 2) and backward (represented by arrow 117, FIG. 2) are combined in parallel across the gap of the long slot. When the slot is fed by a balanced (push-pull) feed, then each feed line carries half the total load impedance burden at the slot 102. With only half the load impedance to be transformed back to a normal 50 ohm output impedance of the feed circuit, the array reduces the antenna depth by a factor one the order of 25%. Further reduction can be obtained when the impedance transformation section is folded in planer circuits behind the back plane.

In an exemplary embodiment, a long slot excited by high impedance balanced feeds is capable of supporting ~4:1 bandwidths with the antenna thickness (including the impedance transformer) reduced to ½ wavelength deep at the high end of the band, and less than ⅛ wavelength deep at the lowest frequency. The antenna can support 5:1 bandwidths with slightly lower efficiency. By employing a back plane having a boundary condition which is an open circuit over the full bandwidth instead of just at the ¼ wavelength optimally, the frequency range can be extended to up to 100:1 bandwidths.

Figure 3:
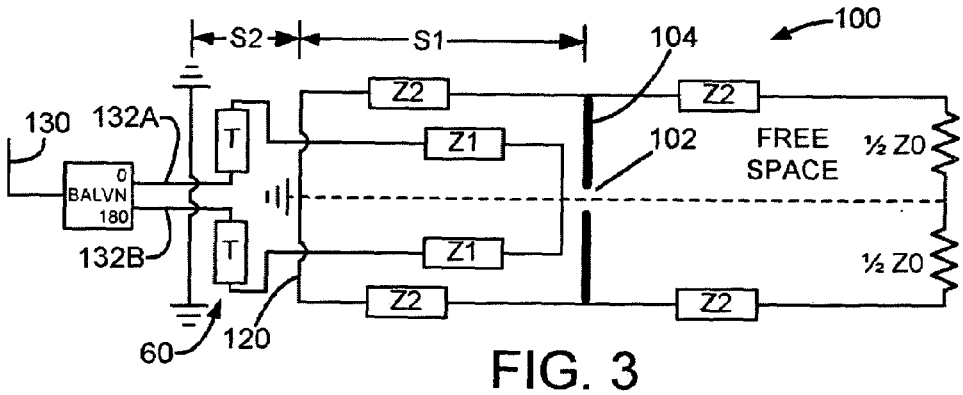
FIG. 3 is a simplified equivalent circuit describing the antenna aperture of FIG. 1 per unit cell.

The periodically fed long slot can be modeled as a simple equivalent circuit, illustrated in FIG. 3, which describes the antenna aperture per unit cell 100 to a first order and is helpful when performing design tradeoffs. The input to, or output from, the unit cell 100 is an unbalanced source 130 in an exemplary embodiment, typically a 50-ohm transmission line, e.g. coaxial, or stripline, from a transmitter or a receiver. The signal at this point can have a unique phase at each unit cell for two-dimensional (2-D) beam scan, provided through a corporate feed network or through variable phase shifters controlled by a beam steering controller. Alternatively in a simplified form the cells can all be driven by signals of the same phase. A balun structure 132 splits the single input into two arms 132A, 132B, adding an extra 180-degree phase shift to the second port 132B. Baluns are well known to those skilled in the art, and can use a small lumped element wire-wound on a ferrite toroid with 50 ohms input and outputs. Their frequency response can be flat and stable over decade bandwidths, with less than 0.5 dB loss below 2 GHz. Distributed circuit baluns suitable for the purpose can be readily designed for frequencies above 2 GHz by those skilled in the art.

The 50 ohm input to the balun 132 is typically low compared to the unit cell wave impedance, Z0, which, in an exemplary embodiment is 377 ohm for b/a=1 in a square lattice. Therefore, a wideband impedance transformer 60 can be used to maintain good efficiency. Some of the impedance transformation can be done in the balun itself, but also can be included in a stripline layer between the balun and the backplane. The layer containing the stripline transformer is relatively thin and of negligible thickness (denoted by S2 in FIG. 3) with respect to wavelengths for UHF frequencies. The output impedance of the transformer 60 matches to that of the slot, controlled by the unit cell aspect ratio b/a, and is usually high for applications which do not employ a dielectric radome. The load impedance of the slot is high as long as the back plane depth behind the slot, denoted by S1 in FIG. 3, is greater than 12% but less than 60% wavelength at mid-band.

By folding the impedance transformation behind the back plane in thin stripline layers or in the balun or both, the long slot array antenna can be made very thin, with as much as 50% depth reduction compared to the state of the art wide band array antennas. This design is scaleable (assuming the fabrication of feed lines and baluns can also be scaled and implemented) to other frequency bands and the antenna based on this approach will be proportionally thinner compared to other existing designs. Referring to FIG. 3, the unit cell wave impedance Z0=Z1=½ 377 a/b, in air. The slot impedance is 2 Z1. If a dielectric radome is place over the slot structure, the impedance Z2 in the region between the slot and free space will be affected. Similarly, the impedance Z2 in the reverse direction would be affected by the presence of dielectric support structure to hold the feed probes. It is desired that the transformed impedance of the circuit which is seen at the balun ports 132A and 132B be matched to the impedance looking into the balun. Therefore, depending on the impedance transformation circuit 60 and choice of support structures and length S1, the impedances Z2 may not be equal to Z1 or Z0. In one embodiment, the lowest profile antenna which yielded the widest bandwidth employed Z1=Z2=Z0.

An exemplary embodiment of the antenna is constructed to operate between 0.4 and 2 GHz (5:1 Bandwidth). A lattice spacing of 3 inches by 3 inches is chosen to support +/−60 degrees of grating lobe free scan in both the E- and H-planes at the highest frequency. Copper tapes adhered to foam create the slots. A second layer of foam, S1, about 2 inches thick supports the high impedance feeds. The thickness of S1 is 2.4 inches, and an additional 0.8 inches for S2 was employed for the air-foam stripline transformer to match 188 ohm feed line impedance to 50 ohm input. All the layers used foam substrates laminated in between copper foils, and the construction demonstrated a very low weight array antenna. With a total thickness of 3.2 inches, the array was only about 10% wavelength thick at the lowest operating frequency. The construction of this exemplary antenna provided an antenna with a 5:1 bandwidth embodied in a low profile structure, with a depth as small as only 0.1 wavelength at the low end of the band and an efficiency greater than 90% across the whole range (80% including balun).

In a typical design, the slot widths are adjusted to balance the capacitive stored reactive energy between two opposing sides of the slot with the inductive reactive energy stored surrounding the feed traversing the slot. In an exemplary embodiment, this balance tends to suggest that ~50% of the metal per unit cell be left in place. The remaining conductive material serves a secondary purpose, i.e. as a floating ground plane for a microstrip mode of the feed structure.

Figure 4:
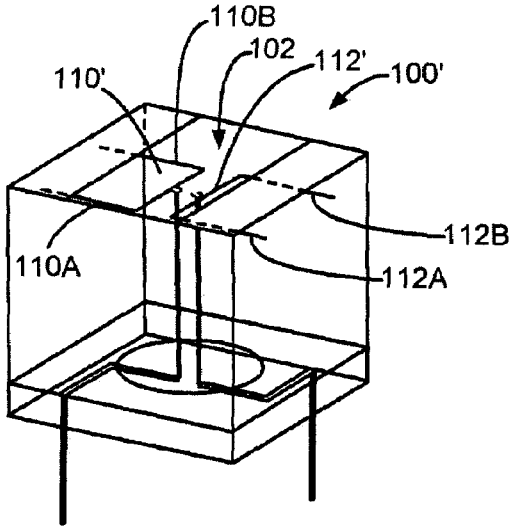
FIG. 4 illustrates a first alternate embodiment of the feed structure for a continuous slot antenna array.
Figure 5:
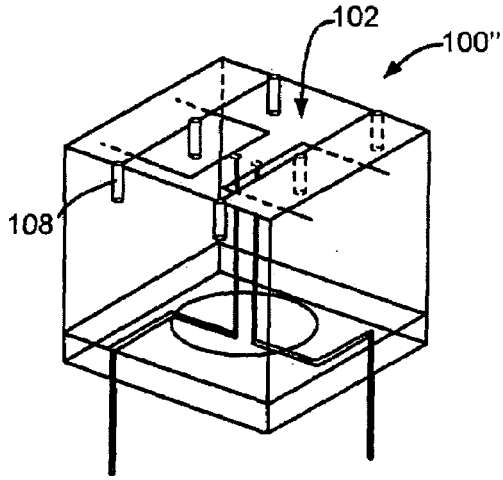
FIG. 5 illustrates a second alternate embodiment of the feed structure for a continuous slot antenna array.

FIGS. 4 and 5 illustrate alternate embodiments of the feed structure. Simulations have demonstrated that the spacing between the feed ports can be greater than 0.5 wavelength at the highest operating frequency by splitting the feed into two equally spaced parallel paths to excite the slot. This is illustrated in FIG. 4, wherein a unit cell 110' of the array includes feed lines 110' and 112' to excite slot 112. The feed line 110' comprises parallel lines 110A and 110B. Similarly, line 112' includes parallel lines 112A, 112B. This modification of the feed structure allows a lesser number of baluns and the active electronics feeding the baluns per unit area of the array while yielding the same radiation performance. Ideally, this modified feed structure could provide an increase in the spacing by a factor of two at the most, although in practice lower factors, on the order of 1.5 may be achieved. Also, the scan performance can be improved to reduce loss by placing short posts as baffles inside and underneath the slot. This feature is shown in FIG. 5, wherein short posts 108 are positioned on the edges of the slot 102.

Figure 6:
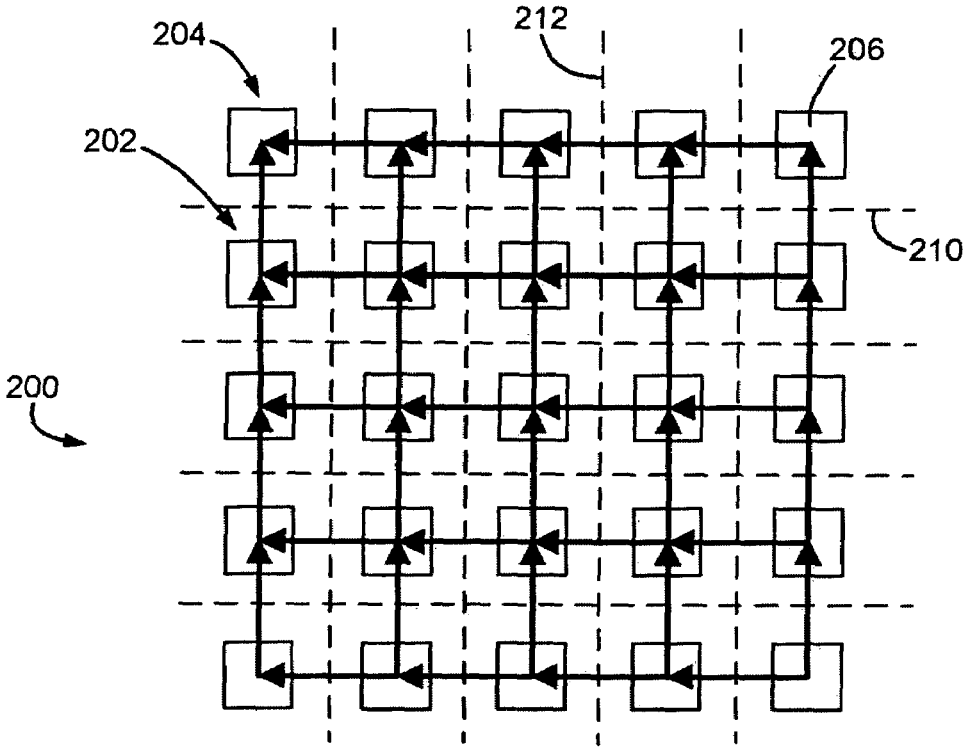
FIG. 6 is a diagrammatic top plan view of an exemplary embodiment of a dual polarization antenna array.
Figure 7:
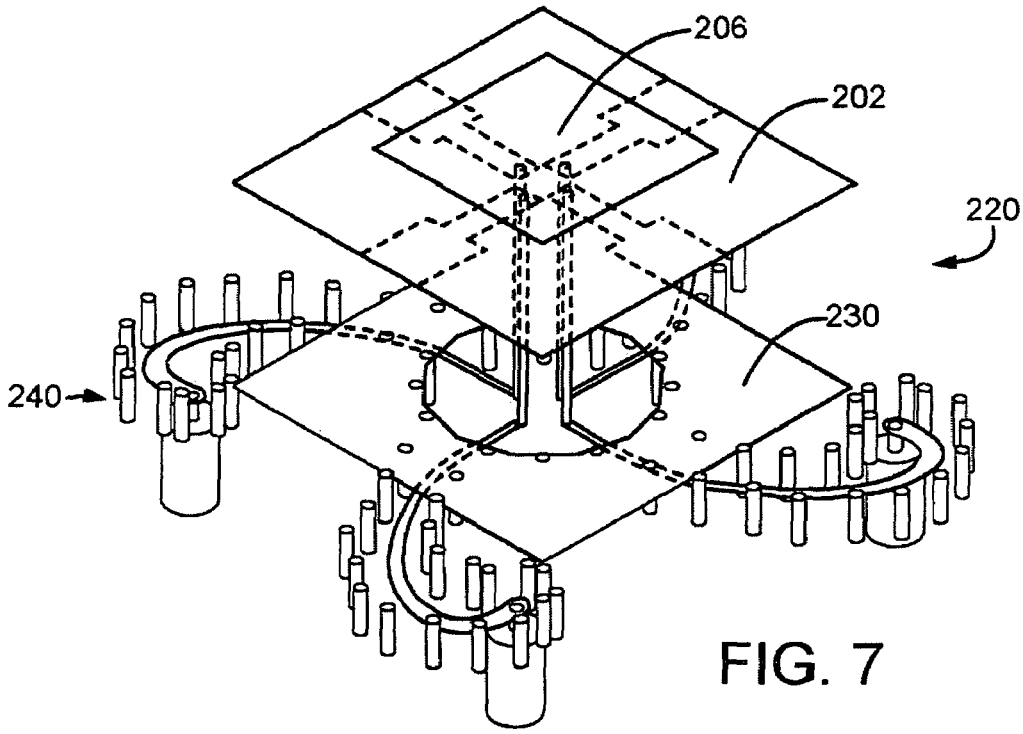
FIG. 7 is a diagrammatic isometric exploded view of an embodiment of a unit cell comprising the array of FIG. 6.
Figure 8:
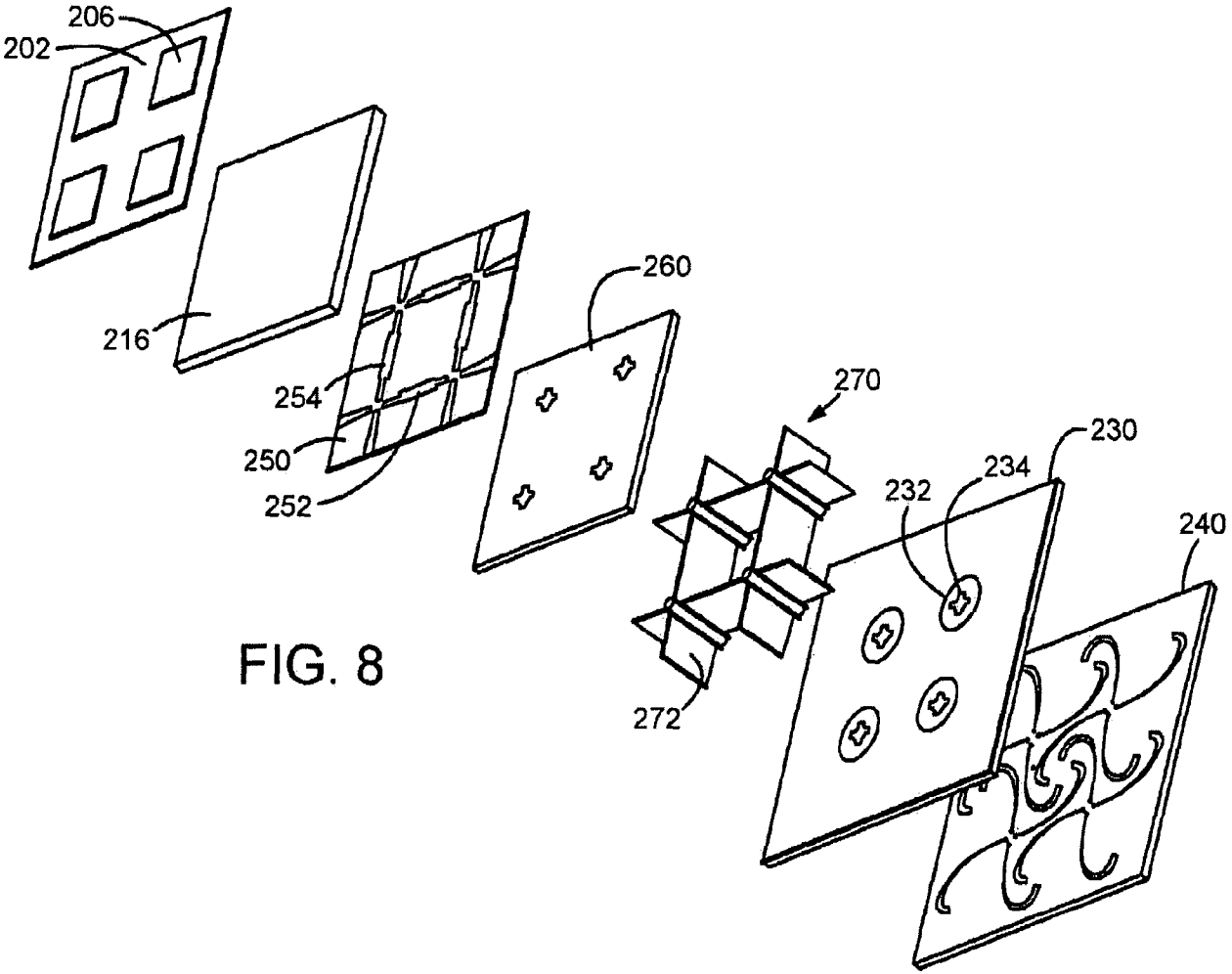
FIG. 8 is an exploded fragmentary isometric view of elements of an exemplary implementation of the array of FIG. 6.

In another embodiment, an antenna array with dual polarizations is provided by interleaving two orthogonal sets of slots and feeding appropriately for each set of slots as described above for the single linear polarization case. An exemplary dual polarization embodiment is illustrated in FIGS. 6-8. FIG. 6 is a diagrammatic top plan view of an antenna array 200, wherein a conductor pattern 204 in the form of a checkerboard geometry is defined on the top surface of a dielectric substrate 202. In this embodiment, slots are formed in the conductor pattern in two orthogonal directions, in this case horizontally and vertically, to form a checkerboard pattern of conductive pads 206. Thus, a series of parallel horizontal slots are formed along horizontal slot axes 210, and a series of parallel vertical slots are formed along vertical slot axes 212. High impedance balanced feeds excite the slots under the pads 206. The bold arrows represent the vector orientation of the electric fields in the regions between the pads. There are two directions, vertical and horizontal, in contrast to the vector orientation of the electric fields in the linear polarization case depicted in FIG. 1, for example.

FIG. 7 is a diagrammatic isometric exploded view of an embodiment of a unit cell 220 comprising the array 200. The balanced feed for each polarization sense (vertical and horizontal) can be provided by an impedance transformer section 240, a back plane 230 and feed lines having a vertical portion and horizontal portions under the slots.

FIG. 8 is an exploded fragmentary isometric view of elements of an exemplary implementation of the array 200. This fragment shows four pads 206 on the substrate 202. A dielectric foam spacer layer (0.040 inch thick) is positioned between the substrate 202 and a printed wiring board, fabricated of a kapton™ layer 250, 0.003 inch thick, on which is formed a conductor pattern defining the feed lines, including orthogonal lines 252 and lines 254. The kapton layer 250 is positioned against a dielectric face sheet 260 formed of Rogers 4003, 0.025 inch thick, having a hole pattern defined there through to receive conductors 272 carried by an "egg-crate" structure 270, which connect to the feed lines 252, 254 on the printed wiring board 250. The structure 270 is thin, e.g. 0.225 inch thick in this embodiment, and is fabricated of interlocking transversely oriented panels of a thin dielectric material, such as Rogers 4003, on which are formed the vertical feed lines 272. A copper plated back plane structure 240 is fitted behind the structure 270, and has a copper layer 232 formed on a dielectric substrate, e.g. Rogers 4003. Openings 234 are formed in the copper layer to allow connection of the feed lines 272 to the transformer structure 270 without shorting to the layer 232. This construction provides a lightweight, low profile antenna array, comprising a periodic array of orthogonal slots fed by a balanced high impedance feed structure.

Although the foregoing has been a description and illustration of specific embodiments of the invention, various modifications and changes thereto can be made by persons skilled in the art without departing from the scope and spirit of the invention as defined by the following claims.

What is claimed is:

1. A dual polarization antenna array, comprising:

a first array of continuous slots formed in a ground plane structure;

a second array of continuous slots formed in the ground plane structure, said second array orthogonal to said first array to define a checker-board pattern of conductive pads in the ground plane structure;

a first feed structure comprising a first periodically spaced set of probe feeds disposed behind the ground plane structure for exciting the first array of slots;

a second feed structure comprising a second periodically spaced set of probe feeds disposed behind the ground plane structure for exciting the second array of slots; and an eletrically conductive back plane structure arranged behind the first and second sets of probe feeds such that the probe feeds are between the ground plane structure and the back plane structure, the back plane structure providing RF shielding;

wherein each of the first and second feed structures comprises a balanced push-pull feed respectively coupled to each of the first and second sets of probe feeds and comprising a pair of feed lines driven in anti-phase.

2. The array of claim 1, further comprising an impedance transformer for coupling a low impedance transmission structure to a higher load impedance of the continuous slots.

3. The array of claim 2, wherein the impedance transfomer comprises a stripline impedance transformer circuit positioned behind the back plane structure.

4. The array of claim 3, wherein the stripline impedance transformer circuit transforms an impedance of 50 ohms into the load impedance of the continuous slot.

5. The array of claim 1, wherein said ground plane structure is a planar structure.

6. The array of claim 1, wherein the probe feeds each comprise a pair of feed wires each connected to a feed wire portion which is positioned in a general parallel orientation relative to the ground plane structure.

7. The array of claim 1, wherein the array operates in a band between 4 Ghz and 16 Ghz.

8. An antenna array, comprising:

an array of continuous slots formed in a conductor plane structure;

a balanced push-pull feed structure for exciting the array of continuous slots, the balanced push-pull feed structure comprising a periodic set of probe feeds disposed behind the conductor plane structure; and a back plane structure comprising a conductive layer disposed behind the set of probe feeds and spaced a distance S1 from the conductor plane structure, such that the set of probe feeds is sandwiched between the conductor plane structure and the back plane structure;

wherein the antenna array has an operating band, and wherein said S1 distance is greater than 12% of a mid-band wavelength and less than 60% of the mid-band wavelength.

* * * * *